US008739435B2

(12) United States Patent
Girard

(10) Patent No.: US 8,739,435 B2
(45) Date of Patent: Jun. 3, 2014

(54) FOOTWEAR WITH IMPROVED SOLE ASSEMBLY

(75) Inventor: François Girard, Veyrier du Lac (FR)

(73) Assignee: Salomon S.A.S., Metz-Tessy (FR)

( * ) Notice: Subject to any disclaimer, the term of this patent is extended or adjusted under 35 U.S.C. 154(b) by 439 days.

(21) Appl. No.: 13/020,394

(22) Filed: Feb. 3, 2011

(65) Prior Publication Data

US 2011/0185596 A1 Aug. 4, 2011

(30) Foreign Application Priority Data

Feb. 4, 2010 (FR) ..... 10 00454

(51) Int. Cl.
*A43B 5/04* (2006.01)
*A63C 9/08* (2012.01)

(52) U.S. Cl.
USPC ..... 36/117.3; 36/117.1; 36/117.2; 36/117.5; 280/615

(58) Field of Classification Search
None
See application file for complete search history.

(56) References Cited

U.S. PATENT DOCUMENTS

| | | | | |
|---|---|---|---|---|
| 4,842,293 | A * | 6/1989 | Rochard | 280/615 |
| 4,907,353 | A * | 3/1990 | Wittmann et al. | 36/117.2 |
| 4,945,658 | A * | 8/1990 | Provence | 36/117.2 |
| 5,664,797 | A * | 9/1997 | Haughlin | 280/615 |
| 6,017,050 | A * | 1/2000 | Girard | 280/615 |
| 6,182,999 | B1 * | 2/2001 | Bourdeau | 280/607 |
| 6,289,610 | B1 * | 9/2001 | Girard et al. | 36/117.2 |
| 6,402,184 | B1 * | 6/2002 | Hauglin | 280/615 |
| 6,481,121 | B1 * | 11/2002 | Tucker | 36/62 |
| 6,536,795 | B2 * | 3/2003 | Okajima et al. | 280/613 |
| 6,637,767 | B2 * | 10/2003 | Chevalier et al. | 280/607 |
| 6,811,177 | B2 * | 11/2004 | Lancon et al. | 280/615 |
| 6,986,526 | B2 * | 1/2006 | Haughlin | 280/613 |
| 7,025,372 | B2 * | 4/2006 | Godde et al. | 280/607 |
| 7,931,292 | B2 * | 4/2011 | Miralles | 280/615 |
| 8,201,845 | B2 * | 6/2012 | Girard et al. | 280/617 |
| 2001/0011808 | A1 * | 8/2001 | Chevalier et al. | 280/607 |
| 2006/0012152 | A1 * | 1/2006 | Quellais et al. | 280/615 |
| 2007/0235984 | A1 * | 10/2007 | Miralles | 280/615 |
| 2008/0127523 | A1 * | 6/2008 | Hauglin | 36/117.2 |
| 2010/0313448 | A1 * | 12/2010 | Girard et al. | 36/117.3 |

FOREIGN PATENT DOCUMENTS

| | | | |
|---|---|---|---|
| EP | 0 732 066 | A1 | 9/1996 |
| EP | 768103 | A1 * | 4/1997 |
| EP | 787440 | A1 * | 8/1997 |
| FR | 2 565 117 | A1 | 12/1985 |
| FR | 2 572 944 | A1 | 5/1986 |
| FR | 2 604 098 | A1 | 3/1988 |
| FR | 2 770 097 | A1 | 4/1999 |
| WO | WO-2006/085131 | A1 | 8/2006 |

* cited by examiner

*Primary Examiner* — Khoa Huynh
*Assistant Examiner* — Timothy K Trieu
(74) *Attorney, Agent, or Firm* — Greenblum & Bernstein, P.L.C.

(57) ABSTRACT

A boot including an outer sole assembly, the outer sole assembly extending lengthwise from a rear end to a front end, widthwise between a lateral side and a medial side, and heightwise between a free surface and a connection surface, the outer sole assembly having a longitudinal groove that opens out in the area of the free surface. The longitudinal groove opens out in the area of the free surface, the groove having a length ranging between 30 and 100% of the length of the outer sole assembly, a width ranging between 25 and 45 mm, and a depth greater than or equal to 4 mm, the groove being compatible with one or more guiding ribs.

17 Claims, 4 Drawing Sheets

1
16
21
13
17
19
14
20
II
12
18
29
15
II
28
26
25
2
27
30
3

FOOTWEAR WITH IMPROVED SOLE ASSEMBLY

CROSS-REFERENCE TO RELATED APPLICATION

This application is based upon French patent application No. 10.00454, filed Feb. 4, 2010, the disclosure of which is hereby incorporated by reference thereto, and the priority of which is hereby claimed under 35 U.S.C. §119.

BACKGROUND

1. Field of the Invention

The invention relates to footwear, in particular a sports boot, and more particularly a boot that can be used in fields such as cross-country skiing, ski touring or telemark skiing, snowshoeing, roller skating or ice skating, or the like.

2. Background Information

A boot can include a low upper or a high upper, or even a mid-upper, and can be relatively flexible or, conversely, more rigid. In any case, the boot is provided with an outer sole assembly, which is adapted to connect the upper to the ground or to a sports apparatus, such as a ski or other gliding or rolling device.

The outer sole assembly is an element that extends lengthwise from a rear end to a front end, widthwise between a lateral side and a medial side, and heightwise between a free surface, adapted to contact the ground or the sports apparatus, and a connection surface, adapted to be affixed to the upper.

In a known manner, the outer sole assembly sometimes has a longitudinal groove that opens out in the area of the free surface. On occasion, the outer sole assembly has a plurality of longitudinal grooves. This is the case, for example, in the field of cross-country skiing, in which at least one groove is adapted to cooperate with a longitudinal guide rib of a guiding device. The rib is associated with a ski, directly or indirectly. Due the cooperation of each groove of the sole assembly with the associated rib, the boot is guided during the rolling movement of the foot during strides and is maintained transversely, in particular when the foot is in support over the entire length of the sole assembly. This arrangement enables precise steering of the ski, in spite of the boot being retained thereon so that the heel of the boot can be alternately raised and lowered.

This principle is embodied commercially in various assemblies. Indeed, there are guiding devices with a longitudinal rib having a small cross section, guiding devices with a rib having a larger cross section, devices with two ribs, etc. Each corresponding sole assembly has one or more grooves adapted to receive the rib(s). Therefore, there are boots whose sole assembly has a groove having a small cross section, a groove having a larger cross section, two grooves, etc.

In any case, an outer sole assembly is adapted to cooperate with a particular guiding device, i.e., exclusive of any other. Thus, the recessed shape of the outer sole assembly is the counterpart of the embossed shape of the associated guiding device. This optimizes the cooperation between the outer sole assembly and the device, for a more precise control of the ski. It is therefore not possible for a user to retain his/her boots when changing to a new guiding device, unless the guiding device has a structure that is adaptable to the structure of the boot. Changing a guiding device, therefore, is often correlated with changing the device retaining the boot to the ski. Indeed, the two types of devices are very often paired with another for various reasons, such as simplifying their manufacture, matching their aesthetic appearance, or similar reasons. The user may wish to change his/her retaining devices, or skis, which can be provided with retaining and guiding devices. However, the user is generally not very inclined to change his/her boots, because the various models do not offer exactly the same sensations of comfort or of foot support. Therefore, a problem arises if the user is not able to keep his/her boots when changing the guiding devices, the retaining devices, or the skis.

SUMMARY

In view of the foregoing, the invention enables the user to change guiding devices while keeping his/her boots.

More broadly speaking, the invention enables a given boot to be used with various guiding devices having different structures.

By extension, the invention enables various retaining devices, or even various skis, to be used with the same pair of boots.

To this end, the invention is directed to a boot having an outer sole assembly, the outer sole assembly extending lengthwise from a rear end to a front end, widthwise between a lateral side and a medial side, and heightwise between a free surface and a connection surface, the outer sole assembly having a longitudinal groove that opens out in the area of the free surface.

A boot according to the invention includes a longitudinal groove that opens out in the area of the free surface, in which the groove has a length ranging between 30 and 100% of the length of the outer sole assembly, a width ranging between 25 and 45 mm, and a depth greater than or equal to 4 mm, the groove being compatible with one or more guide ribs.

The groove is adequately dimensioned to receive a large-sized rib, or one or more smaller ribs. A free space remains a free space in the groove, when the latter is occupied by one or more ribs. However, the groove cooperates with each rib that it receives. Consequently, a small-sized rib cooperates with the groove via a reduced surface, i.e., a smaller surface than that used when the rib and the groove have completely complementary shapes. According to the invention, a cooperation of partially complementary forms enables the outer sole assembly to be guided adequately. This means that the guiding of the sole assembly enables a sufficiently precise steering of the ski, in spite of the reduced contact surfaces between the rib(s) and the groove. Therefore, the invention overcomes the preconceived notion that only completely complementary shapes guarantee adequate guiding.

A boot according to the invention can thus advantageously be used with various guiding devices. By extension, the boot can be used with various retaining devices and/or skis. The user can therefore keep his/her boots and have or use equipment having any of a variety of structures.

In general, the invention improves the outer sole assembly of a boot, in particular because of its improved arrangement of characteristics.

BRIEF DESCRIPTION OF DRAWING

Other characteristics and advantages of the invention will be better understood from the description that follows, with reference to the annexed drawings illustrating, by way of non-limiting embodiments, how the invention can be embodied, and in which.

DETAILED DESCRIPTION

The embodiments described hereinafter relate more particularly to boots adapted for the practice of the cross-country skiing, ski touring, or telemark skiing. However, the invention applies to other fields, including those mentioned hereinabove.

A first embodiment is described hereinafter with reference to FIGS. 1 and 2.

Figure 1:
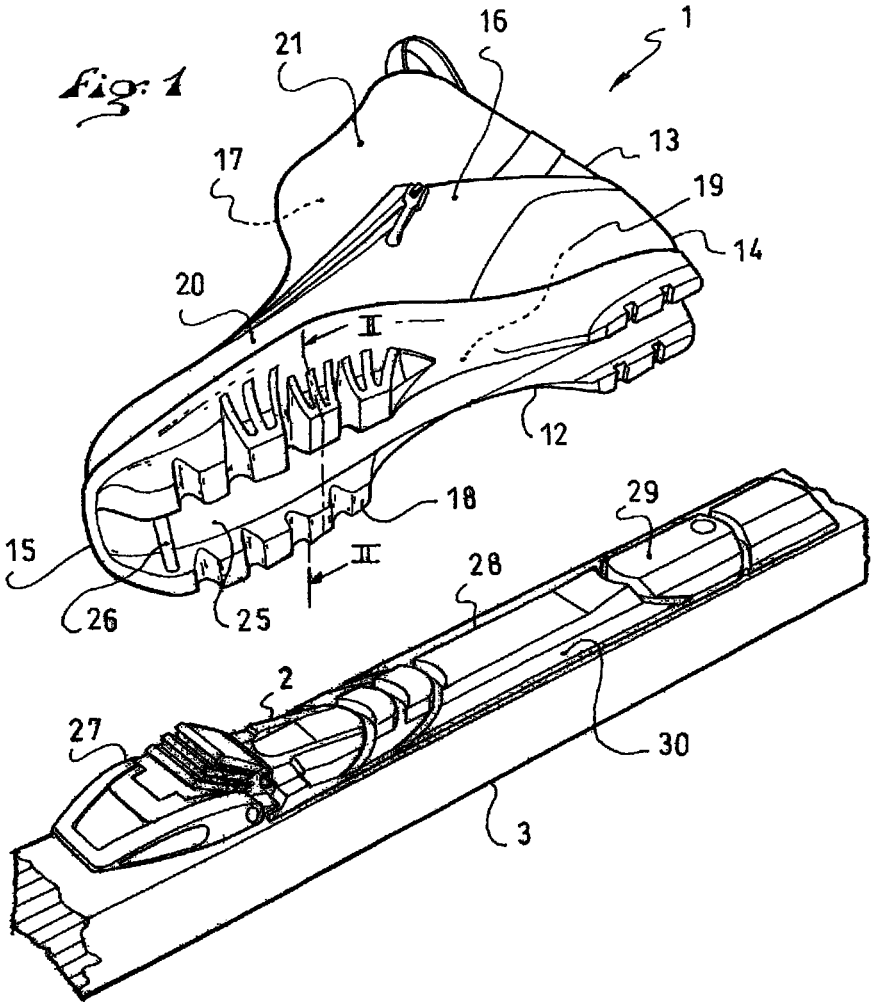
FIG. 1 is a perspective view showing a boot, a portion of a gliding board, as well as a device for temporarily retaining the boot on the board, according to a first embodiment of the invention.

As shown in FIG. 1, from a general point of view, a cross-country ski boot 1 is adapted to be removably retained by a retaining device 2, or binding, on a board 3, or ski.

In a known manner, the boot 1 includes an outer sole assembly 12 and an upper 13. The boot 1 extends lengthwise from a rear end or heel 14 to a front end or tip 15, and widthwise between a lateral side 16 and a medial side 17. Consequently, the outer sole assembly 12 extends lengthwise from the heel 14 to the tip 15, and widthwise between the lateral side 16 and the medial side 17. The sole assembly 12 also extends heightwise, or depthwise, between a free surface 18 and a connection surface 19. The free surface 18 is adapted to contact the ground, the device for retaining the boot to the ski, or the ski itself. The connection surface 19 is used to affix the sole assembly 12 to the remainder of the boot using adhesive bonding, for example.

As shown, the upper 13 includes a lower portion 20, adapted to surround the foot, as well as an upper portion 21, adapted to surround the ankle. However, the upper could be provided to include only the lower portion. That is, the boot 1 can have a high upper or a low upper, i.e., an upper that extends above the ankle or below the ankle, or even a so-called mid-upper in which the top edge of the upper is positioned at the vicinity of the ankle.

In order to cooperate with the retaining device 2, as explained hereinafter, the outer sole assembly 12 has a longitudinal groove 25 and carries a first connecting member 26. The longitudinal groove 25 opens out in the area of the free surface 18, i.e., in the area of the ground-contacting surface, and extends from the rear end 14 to the front end 15, i.e., along 100% of the length of the sole assembly 12. The groove 25 is divided up, because the free surface 18 has studs, i.e., longitudinally spaced-apart tread blocks. However, in an alternative structure or embodiment, the groove 25 can be continuous. The connecting member 26, well-known to one of ordinary skill in the art, is anchored in the sole assembly 12. The connecting member 26 is for example made from a wire, or pin or rod, having a circular cross section, bent or shaped as needed and positioned transversely in the groove 25, i.e., extending across the groove, in the vicinity of the front end 15.

The retaining device 2, or binding, also well-known to one of ordinary skill in the art, is shown summarily. The retaining device 2 includes a mechanism 27 for temporarily retaining the boot 1, as well as a device 28 for guiding the boot 1.

The mechanism 27 cooperates with the connecting member 26. As a result, when the boot 1 is retained on the ski, the heel 14 of the boot can be alternately raised and lowered with respect to the guiding device 28, while the tip 15 oscillates with respect to the connecting member 26.

The guiding device 28 includes an rib 29, or tongue. The rib 29 is divided longitudinally in order to promote its flexing along a transverse axis during skiing and the flexing of the ski 3, thus providing the ski with increased flexional freedom. However, a continuous rib is also encompassed by the invention. The retaining device 2 includes a base plate 30, which carries the retaining mechanism 27 and the guiding device 28. These three elements 30, 27, 28 are affixed to one another to form a unit that is easy to handle and position on the ski 3. Thus, when the boot 1 is in support on the retaining device 2, the rib 29 is positioned in the groove 25, the connecting member 26 is positioned in the mechanism 27, and the free surface 18 of the sole assembly 12 is supported on the base plate 30, such as being in engagement with the upper surface of the base plate 30, i.e., on the upper surfaces on opposite sides of the rib 29.

The ski 3 is shown partially and schematically. The ski can have any of a plurality of structures that are suitable for use according to the invention.

Figure 2:
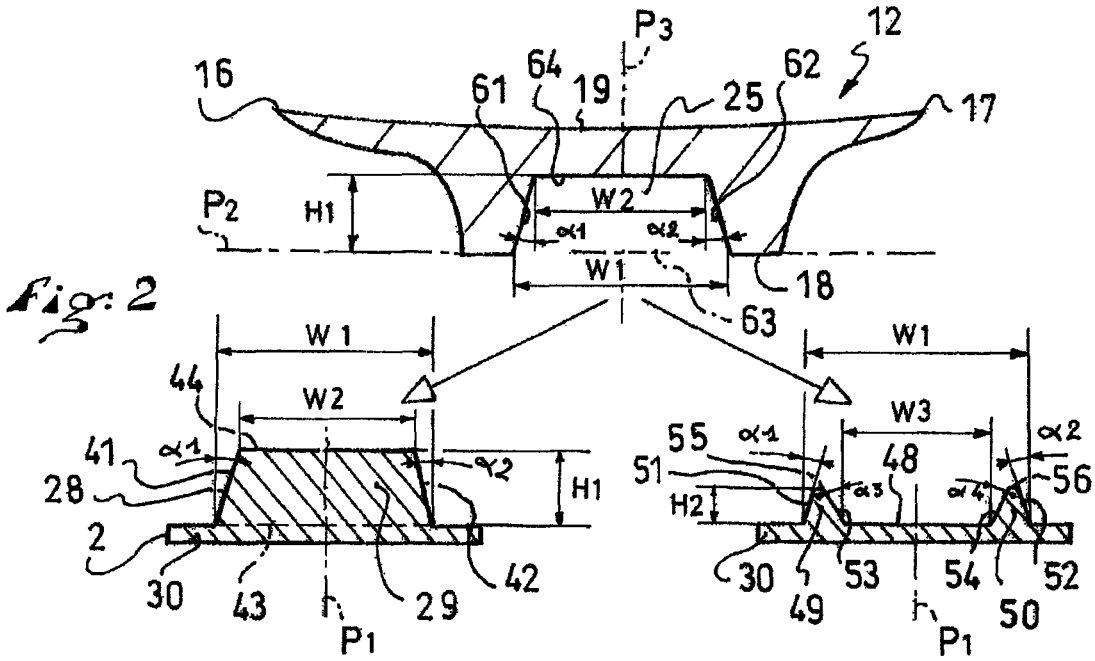
FIG. 2 shows a schematic transverse cross section of the outer sole assembly of a boot, along the line II-II of FIG. 1, as well as two transverse cross sections of two different guiding devices, for the first embodiment of the invention.

According to the invention, and with reference to FIGS. 1 and 2, the longitudinal groove 25 of the sole assembly 12 opens out in the area of the free surface 18, the groove having a length ranging between 30 and 100% of the length of the outer sole assembly 12, a width ranging between 25 and 45 mm, and a depth greater than or equal to 4 mm, the groove being compatible with one or more guiding ribs. The length is measured along a longitudinal direction of the boot from one end 14, 15 to the other. The width is measured along a transverse direction from one side 16, 17 to the other. Finally, the depth is measured perpendicular to the sole assembly 12, from the free surface 18.

The aforementioned configuration enables the longitudinal groove 25 to receive one or more ribs, which can have different cross sections. In other words, the groove 25 enables the sole assembly 12 to adapt to various retaining devices, and consequently to various guiding devices, as described in detail hereinafter.

The guiding device 28 of FIG. 1, designated as the first device, is shown in a schematic transverse cross section, at the bottom left side of FIG. 2. Here, the rib 29 and, base plate 30 form a unitary element. The rib 29 has a trapezoidal transverse cross section, with a lateral surface 41 opposite a medial surface 42, as well as a bottom portion 43 opposite a top portion 44. The bottom portion 43 of the rib 29 is shown in broken line; it corresponds to the limit between the rib 29 and the base plate 30. The lateral surface 41 and medial surface 42 form an angle $\alpha 1$ and $\alpha 2$, respectively, with a longitudinal plane $P_1$ perpendicular to the base plate 30. The values of the angles $\alpha 1$, $\alpha 2$ range between 1 and 40°. In particular embodiments, favorable results can be obtained for values ranging from 5 to 25°. The bottom portion 43 of the rib 29, parallel to the base plate 30, has a width W1 ranging between 25 and 45 mm. In particular embodiments, favorable results can be obtained for values ranging between 25 and 33 mm. The top portion 44, which is parallel to the base plate and to the bottom portion 43, has a width W2 ranging between 22 and 28 mm. The bottom portion 43 is wider than the top portion 44. The height H1 of the rib 29, measured between the base plate 30 and the top portion 44, ranges between 4 and 30 mm. In particular embodiments, favorable results can be obtained for values ranging between 5 and 22 mm.

A second guiding device 48 is shown in a schematic transverse cross section, at the bottom right side of FIG. 2. The base plate 30 is associated this time with two ribs, viz., a lateral rib 49 and a medial rib 50. The ribs 49, 50 are oriented lengthwise along the length of the base plate 30. The ribs 49, 50 are symmetrically arranged with respect to the longitudinal plane $P_1$, the plane $P_1$ being transversely centered with respect to the base plate 30. Each rib 49, 50 has a trapezoidal cross section. The lateral rib 49 has a lateral surface 51 which, with the plane $P_1$, forms an angle $\alpha 1$ similar or equal to that of the first device 28. Similarly, the medial rib 50 has a medial surface 52 which, with the plane $P_1$, forms an angle $\alpha 2$ similar or equal to that of the first device 28. Facing one another, the ribs 49, 50 have inner surfaces 53, 54, respectively, each of which, with the plane $P_1$, forms an angle $\alpha 3$, $\alpha 4$ whose value ranges between 3 and 40°. In particular embodiments, favorable results can be obtained for values ranging between 5 and 25°. The height H2 of each rib, measured between the base plate 30 and their respective top portions 55, 56, ranges between 3 and 8 mm. In particular embodiments, favorable results can be obtained for values ranging from 4 with 5 mm. The distance W1 that separates the ribs 49, 50, at their junction with the base plate 30 and at the base of the lateral 51 and medial 52 surfaces, is equal to the width W1 of the bottom portion 43 of the rib 29 of the first device 28. The distance W3 that separates the base from the inner surfaces 53, 54, ranges between 14 and 23 mm.

The groove 25 of the sole assembly 12 is next described more particularly, with regard to its structure and its cooperation with the guiding devices 28, 48.

As shown at the top of FIG. 2, the groove 25 is adapted to be nested exactly on the rib 29 of the first guiding device 28. For this reason, the groove 25 has a trapezoidal cross section, with a lateral surface 61 opposite a medial surface 62, as well as a bottom portion 63 opposite a top portion 64. Here, the bottom portion 63 is shown in broken line: it is contained in the plane $P_2$, which extends through the free surface 18 of the sole assembly 12. The bottom portion 63 is the inlet, or entry, of the groove 25. The entry 63 has a width W1 equal to that of the bottom portion 43 of the rib 29. The width W1 can therefore be referred to as the bottom width of the groove. The top portion 64 demarcates the base of the groove 25. The top portion 64 has a width W2 equal to that of the top portion 44 of the rib 29. Consequently, the base 64 of the groove 25 is narrower than the entry 63. In other words, the groove 25 narrows down in a direction extending from the entry towards the base.

The lateral surface 61 and medial surface 62, i.e., the lateral side of the groove and the medial side of the groove, are adapted to contact the lateral 41 and medial 42 surfaces of the rib 29 of the first guiding device 28, or the lateral surface 51 and medial surface 52 of the lateral 49 and medial 50 ribs of the second guiding device 48, respectively. The lateral surface 61 and the medial surface 62 of the groove 25 are inclined along angles $\alpha 1$ and $\alpha 2$, respectively, equal or similar to those of the rib 29. The angles $\alpha 1$ and $\alpha 2$ are measured with respect to a plane $P_3$ perpendicular to the base or top portion 64. Here, the angles $\alpha 1$ and $\alpha 2$ are equal. Consequently, the groove 25 is transversely symmetrical. The depth of the groove 25, or the distance between the entry 63 and the base 64, is equal or close to the distance H1, which is the height of the rib 29. In other words, the depth of the groove 25 is equal or close to the height of the rib 29 and, therefore, ranges between 4 and 30 mm.

According to the first embodiment, the groove 25 cooperates, at least, either with a single rib of the same transverse cross section, or with two smaller ribs, certain surfaces of which are arranged to cooperate with the groove 25. An advantage of the sole assembly 12 is to cooperate with at least two different guiding devices. When the groove 25 cooperates with a single rib 29 having the same transverse cross section as the groove, a functional clearance can be had between the top portion 44 of the rib and the base 64 of the groove. Consequently, the sole assembly 12 takes support on the base plate 30 via its free surface 18. This increases the stability of the support.

The other embodiments of the invention are described hereinafter with reference to FIGS. 3 to 6. For reasons of convenience, the common elements shared with the first embodiment are designated by the same reference numerals.

Figure 3:
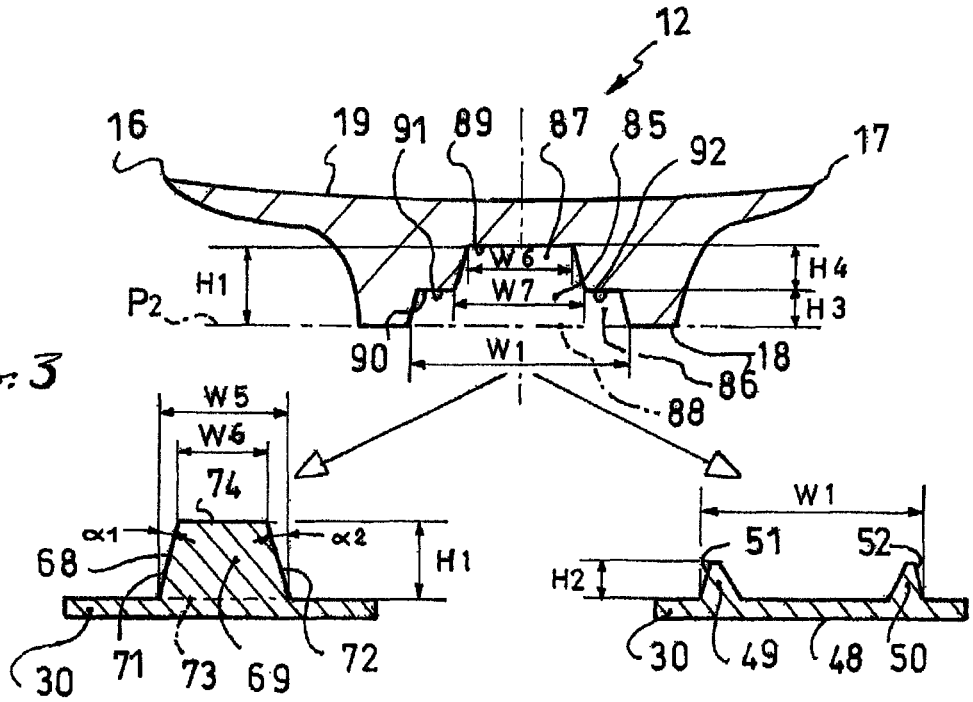
FIG. 3 is similar to FIG. 2, for a second embodiment of the invention.

The second embodiment, according to FIG. 3, features an outer sole assembly 12, a second guiding device 48, as well as a third guiding device 68. It can be seen that the sole assembly 12 is structured to cooperate with the second 48 and third 68 devices. Having been described previously, the second device 48 is not described here. The third device 68 is similar to the first but with a reduced width. Thus, the third device 68 includes a guiding rib 69, a lateral surface 71, a medial surface 72, a bottom portion 73, and a top portion 74. The surfaces 71, 72 are inclined depending upon the values of the angles $\alpha 1$ and $\alpha 2$ mentioned previously. The bottom portion 73 of the rib 69 has a width W5 ranging between 15 and 20 mm. The top portion 74 of the rib 69 has a width W6 ranging between 10 and 15 mm. The height H1 of the rib 69 ranges between 10 and 30 mm.

To cooperate with each of the guiding devices 48, 68, the groove 85 of the sole assembly 12 is adapted to be nested partially on the second guiding device 48, and partially on the third guiding device 68. To this end, the transverse cross section of the groove 85 includes a first trapezoidal subdivision 86, as well as a second trapezoidal subdivision 87. The first subdivision 86 demarcates the entry 88 of the groove 85, and the second subdivision 87 demarcates the base 89, the subdivisions being separated by a shoulder 90. The first subdivision 86 is wider than the second subdivision 87. The base 89 of the groove 85 has a width W6 that is equal to that of the top portion 74. The limit between the subdivisions 86, 87, in the area of the shoulder 88, has a width W7 comprised between the widths W5 and W6. The respective depths H3, H4 of the subdivisions 86, 87 each range between 20 and 60% of the depth H1 of the groove 85. For example, the depths of the subdivisions are each equal to 50% of the depth H1. Whereas the lateral and medial sides of the groove 25 of FIG. 2 are constituted by respective ones of the surfaces 61, 62, each of the lateral and medial sides of the groove 85 includes three non-coplanar segments. The lateral side includes the lateral side of the upper subdivision 87, the lateral shoulder portion 91, and the lateral side of the lower subdivision 86. Similarly, the medial side includes the medial side of the upper subdivision 87, the medial shoulder portion 92, and the medial side of the lower subdivision 86.

The first subdivision 86 and second subdivision 87 are transversely symmetrical. This balances the contact forces, in a transverse direction, between the sole assembly 12 and the guiding device 48, 68 with which it cooperates.

Moreover, in the area of the separation between the first subdivision 86 and second subdivision 87 of the groove 85 of the sole assembly 12, the lateral portion 91 and medial portion 92 of the shoulder 90 have the same width. This increases the stability of the sole assembly 12 when taking support on the guiding device 68.

Figure 4:
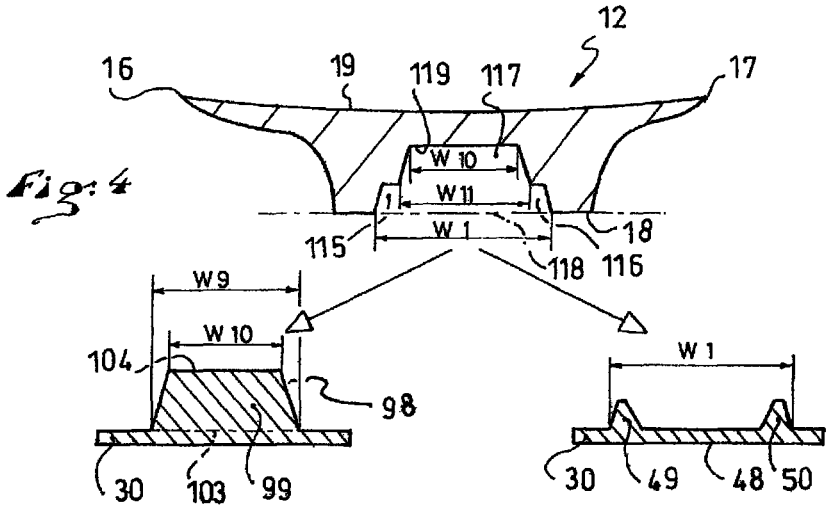
FIG. 4 is similar to FIG. 2, for a third embodiment of the invention.

The third embodiment, according to FIG. 4, features an outer sole assembly 12, a second guiding device 48, as well as a fourth guiding device 98. What differentiates this embodiment from the second embodiment is its scale. In fact, the guiding rib 99 here has a width W9 ranging between 20 and 28 mm, in the area of its bottom portion 103. The rib has a width W10 ranging between 15 and 23 mm, in the area of its top portion 104.

The groove 115 of the sole assembly 12 therefore has a first subdivision 116 and a second subdivision 117, adapted to receive the second 48 and fourth 98 guiding devices. Thus, the entry 118 of the groove has a width W1 ranging between 28 and 45 mm. The width W1 can be referred to as the bottom width of the groove. The base 119 of the groove has a width W10 ranging between 15 and 23 mm. At the separation of the subdivisions 116, 117, the width W11 of the groove is comprised between those of the bottom portion 103 and base 119, i.e., W9 and W10, respectively. According to the third embodiment, the combination of the guiding devices that are compatible with the sole assembly 12 is different. Here again, the first subdivision cooperates with a device 48, whereas the second subdivision 117 cooperates with the other device 98.

Figure 5:
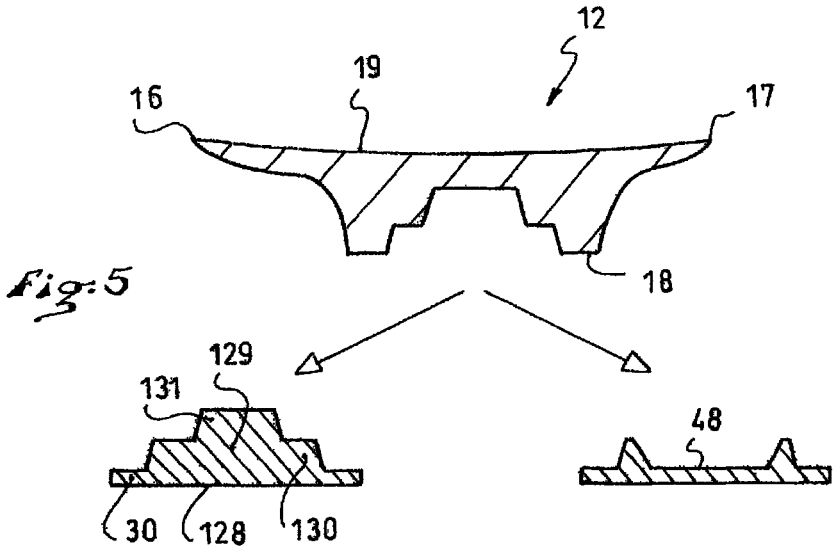
FIG. 5 is similar to FIG. 2, for a fourth embodiment of the invention.

The fourth embodiment, illustrated with reference to FIG. 5, features an outer sole assembly 12, the second guiding device 48, as well as a fifth guiding device 128. What is particular here is the structure of the guiding rib 129 of the fifth device. The rib 129 includes a wide portion 130 extended by a narrow portion 131, each portion having a trapezoidal transverse cross section. The two portions 130, 131, which can be regarded as upper and lower subdivisions, respectively, of the rib 129, form a unitary structure, i.e., a one-piece structure. This arrangement enables a better transverse distribution of the supporting forces between the sole assembly 12 and the fifth guiding device 128.

Figure 6:
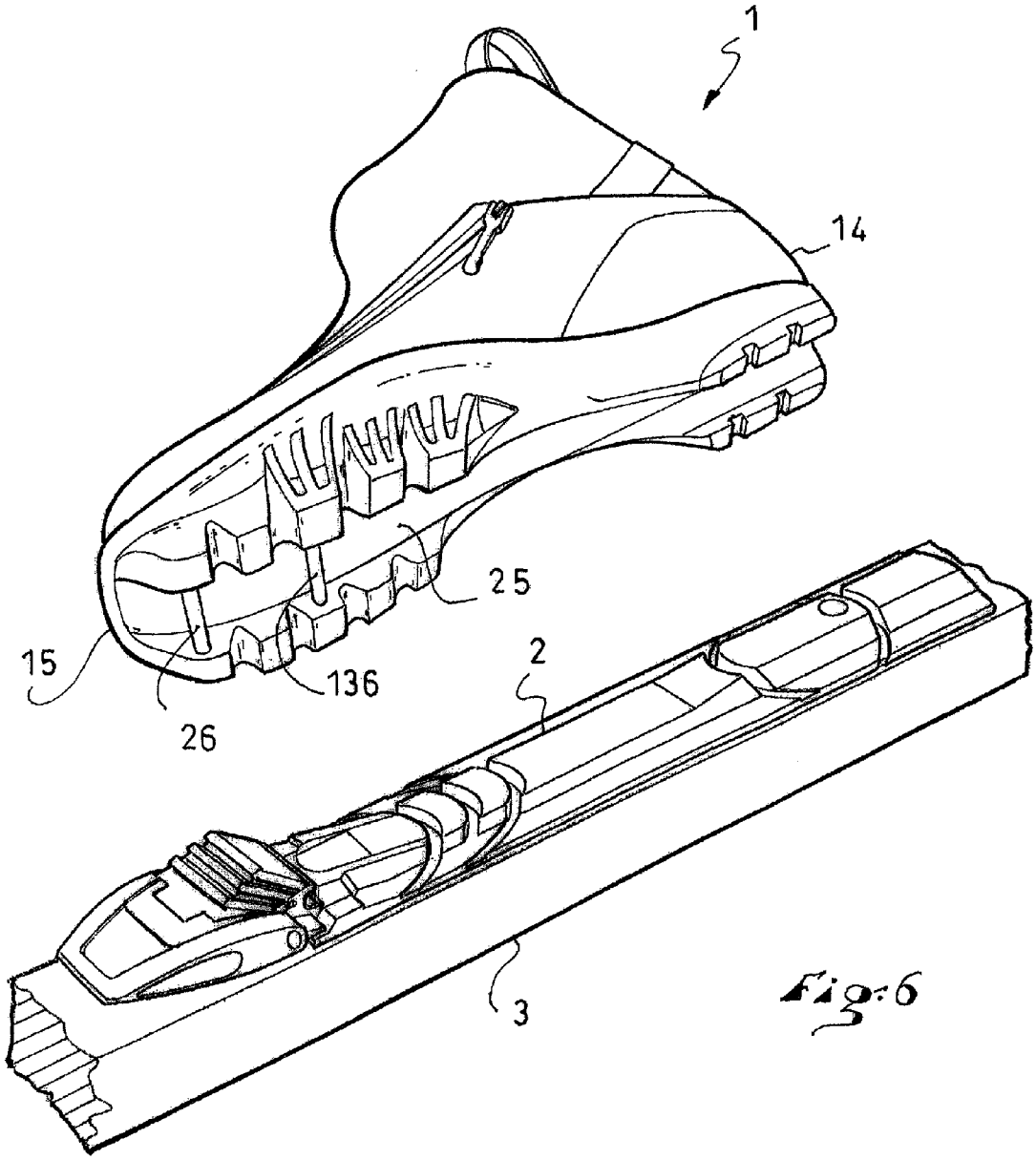
FIG. 6 is similar to FIG. 1, according to a fifth embodiment of the invention.

The fifth embodiment, illustrated with reference to FIG. 6, includes a boot 1, a retaining device 2, and a board 3, or ski. This embodiment is specific in that the boot carries a second connecting member 136, in addition to the first 26. The second member 136 is also anchored in the sole assembly 12. In certain cases, for example, this enables cooperation with a member, not shown, for the elastic return towards the retaining device 2. Finally, it can be said that the boot 1 includes one or two connecting members 26, 136, partially housed in the longitudinal groove 25, 85, 115 of the sole assembly 12. The disclosures of U.S. Pat. No. 7,264,264 and U.S. Pat. No. 7,644,947 are hereby incorporated by reference thereto in their entireties, each disclosing a retaining device, or ski binding, having first and second connecting members, the second cooperating with an elastic return device. For example, as disclosed in both patents, the front connecting member 26 is positioned, e.g., in the area of the front end of the sole, and the rear connecting member 136 is offset rearwardly from the front connecting member and is positioned in the area of, or in front of, a zone of the boot corresponding to the metatarsophalangeal flexion zone of the wearer's foot, i.e., at the end of the front third of the length of the boot. Also, both patents disclose an abutment or elastic buffer for engagement with a front of the boot, which optionally can be used with the invention.

The invention is not limited to the particular embodiments described hereinabove, as it includes all of the technical equivalents that fall within the scope of the claims that follow.

In general, for each trapezoid-shaped transverse cross section of a groove or of a groove subdivision, the angle of inclination $\alpha$1, $\alpha$2 of a lateral surface 51, 71 or medial surface 52, 72 ranges between 1 and 40°. One or two angles $\alpha$1, $\alpha$2 can be provided to vary along the groove. Similarly, the depth(s) H1, H3, H4 can be provided to vary along the groove. Also, the widths W1, W2, W6, W7 can be provided to vary along the groove. In other words, for certain options, the transverse cross section of the groove varies from one its ends to the other.

In addition, the invention illustratively disclosed herein suitably may be practiced in the absence of any element which is not specifically disclosed herein.

The invention claimed is:

1. A boot comprising:

an outer sole assembly having a length extending from a rear end to a front end, a width extending between a lateral side and a medial side, and a height extending between a free surface and a connection surface;

the outer sole assembly having a longitudinal groove having a depth extending from a base to a bottom, the bottom of the groove opening out at a bottom width in an area of the free surface;

the longitudinal groove having a length ranging between 30 and 100% of the length of the outer sole assembly, a bottom width ranging between 25 and 45 mm, and a depth greater than or equal to 4 mm;

the groove being structured and arranged to be compatible in receiving and engaging, laterally and medially, any of a plurality of different guiding devices, said plurality of different guiding devices comprising at least a first guiding device and a second guiding device, the first and second guiding devices having different bottom widths;

the groove having a transverse cross section that includes an upper subdivision and a lower subdivision;

each of the upper and lower subdivisions having a top portion and a bottom portion;

the bottom portion of the upper subdivision having a width less than a width of the top portion of the lower subdivision;

the upper subdivision of the groove including a lateral surface and a medial surface;

the lower subdivision of the groove including a lateral surface and a medial surface;

the lateral surface of the upper subdivision and the lateral surface of the lower subdivision not being coplanar;

the medial surface of the upper subdivision and the medial surface of the lower subdivision not being coplanar;

a lateral shoulder connecting a lower end of the lateral surface of the upper subdivision to an upper end of the lateral surface of the lower subdivision;

a medial shoulder connecting a lower end of the medial surface of the upper subdivision to an upper end of the medial surface of the lower subdivision.

2. The boot according to claim 1, wherein:

the groove has a trapezoidal transverse cross section.

3. The boot according to claim 2, wherein:

each trapezoidal transverse cross section of the groove has a lateral surface or a medial surface with an angle of inclination ranging between 1 and 40°.

4. The boot according to claim 1, wherein:

the upper and the lower subdivisions have respective depths, each ranging between 20 and 60% of a depth of the groove.

5. The boot according to claim 1, wherein:

the upper subdivision and the lower subdivision are transversely symmetrical.

6. The boot according to claim 1, wherein:

the lateral and medial shoulders have identical widths.

7. The boot according to claim 1, wherein:

the upper subdivision has a trapezoid shape;

the lower subdivision has a trapezoid shape.

8. The boot according to claim 7, wherein:

each trapezoid-shaped upper subdivision or the lower subdivision has a lateral surface or a medial surface with an angle of inclination ranging between 1 and 40°.

9. The boot according to claim 1, wherein:

the depth of the groove ranges between 4 and 30 mm.

10. The boot according to claim 1, further comprising:

one or two connecting members structured and arranged to be captured by an assembly for retaining the boot on a sports apparatus;

each of the one or two connecting members being partially exposed within the longitudinal groove of the sole assembly.

11. The boot according to claim 10, wherein:

each of the one or two connecting members is affixed to the sole in or forward of an area of the boot corresponding to a metatarsophalangeal flexion zone of the wearer's foot.

12. The boot according to claim 1, wherein:

the groove being structured and arranged to be compatible in receiving and engaging a plurality of different guiding devices comprises the groove being structured and arranged to be compatible in receiving and engaging at least a first guiding device and a second guiding device;

the first guiding device consists of a single longitudinally extending guiding rib and the second guiding device consists of first and second transversely spaced-apart guiding ribs;

the groove is structured and arranged to engage both (1) a lateral side and a medial side of the single guiding rib of the first guiding devices and (2) a lateral side of the first guiding rib of the second guiding device and a medial side of the second guiding rib of the second guiding device.

13. In combination, a sports boot and a boot-guiding device configured to be mounted on a sports apparatus, said combination comprising:

said sports boot comprising:

an outer sole assembly having a length extending from a rear end to a front end, a width extending between a lateral side and a medial side, and a height extending between a free surface and a connection surface;

the outer sole assembly having a longitudinal groove having a depth extending from a base to a bottom, the bottom of the groove opening out at a bottom width in an area of the free surface;

the longitudinal groove having a length ranging between 30 and 100% of the length of the outer sole assembly, a bottom width ranging between 25 and 45 mm, and a depth greater than or equal to 4 mm;

the groove being structured and arranged to be compatible in receiving and engaging, laterally and medially, any of a plurality of different guiding devices, said plurality of different guiding devices comprising at least a first guiding device and a second guiding device, the first and second guiding devices having different bottom widths;

the groove having a transverse cross section that includes an upper subdivision and a lower subdivision;

each of the upper and lower subdivisions having a top portion and a bottom portion;

the bottom portion of the upper subdivision having a width less than a width of the top portion of the lower subdivision;

the upper subdivision of the groove including a lateral surface and a medial surface;

the lower subdivision of the groove including a lateral surface and a medial surface;

the lateral surface of the upper subdivision and the lateral surface of the lower subdivision not being coplanar;

the medial surface of the upper subdivision and the medial surface of the lower subdivision not being coplanar;

a lateral shoulder connecting a lower end of the lateral surface of the upper subdivision to an upper end of the lateral surface of the lower subdivision;

a medial shoulder connecting a lower end of the medial surface of the upper subdivision to an upper end of the medial surface of the lower subdivision;

said boot-guiding device comprising one of the first and second guiding devices.

14. The combination of claim 13, wherein:

said boot guiding device comprises a longitudinally extending guiding rib.

15. The combination of claim 14, wherein:

the guiding rib has a transverse cross section that includes an upper subdivision and a lower subdivision;

each of the upper and lower subdivisions of the guiding rib has a top and a base;

the base of the upper subdivision has a width less than a width of the top of the lower subdivision.

16. The combination of claim 15, wherein:

each of the upper and lower subdivisions of the guiding rib has a trapezoidal cross section.

17. The combination of claim 15, wherein:

the base of the lower subdivision of the guiding rib has a width less than the width of the lower subdivision of the groove.

* * * * *